United States Patent [19]

Pole

[11] Patent Number: 4,574,989

[45] Date of Patent: Mar. 11, 1986

[54] SWING GATES

[75] Inventor: Charles D. Pole, Willowdale, Canada

[73] Assignee: Upper Lakes Shipping Ltd., Toronto, Canada

[21] Appl. No.: 404,544

[22] Filed: Aug. 2, 1982

[51] Int. Cl.[4] ..... B65D 90/62; B65D 90/64

[52] U.S. Cl. ..... 222/486; 222/502; 222/508; 222/556; 222/560; 105/253; 105/283; 105/287

[58] Field of Search ..... 222/247, 248, 502, 503, 222/508, 556, 560, 485, 486; 105/283, 253, 284, 287

[56] References Cited

U.S. PATENT DOCUMENTS

| | | | |
|---|---|---|---|
| 896,759 | 8/1908 | Robinson | 222/248 |
| 912,887 | 2/1909 | Pool | 198/530 |
| 998,393 | 7/1911 | Reeder | 105/283 |
| 1,258,397 | 3/1918 | Crawford | 198/530 |
| 1,258,420 | 3/1919 | Koenig | 198/530 |
| 1,555,297 | 9/1925 | Kreisinger | 414/199 |
| 2,260,433 | 10/1941 | Cadwell | 222/556 X |
| 2,789,739 | 4/1957 | Aller | 222/556 |

FOREIGN PATENT DOCUMENTS

| | | | |
|---|---|---|---|
| 108165 | 4/1925 | Switzerland | 222/502 |

*Primary Examiner*—Joseph J. Rolla
*Assistant Examiner*—Frederick R. Handren
*Attorney, Agent, or Firm*—Bachman & LaPointe

[57] ABSTRACT

In a hopper or the like wherein the flow of particulate material is controlled by a gate the improvement wherein the gate is mounted to be swingable towards an open position within the hopper so as to break arches and rat holes which form in the material above the gate or a gate adjacent thereto.

15 Claims, 6 Drawing Figures

FIG. 1.
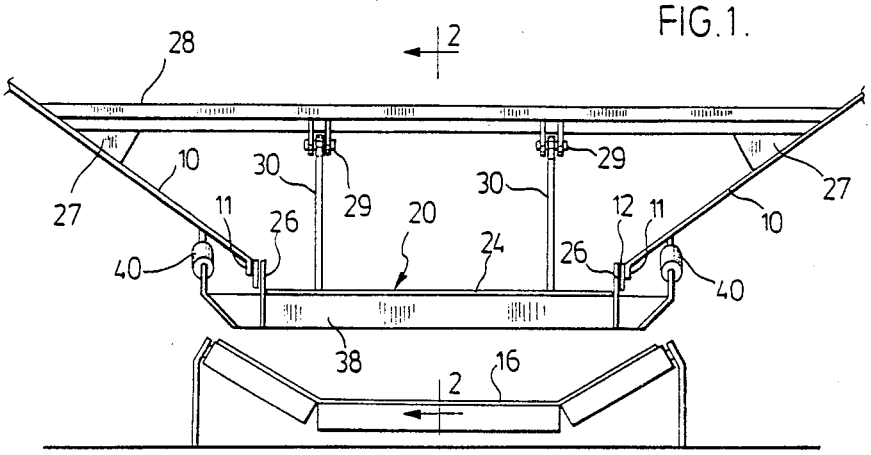
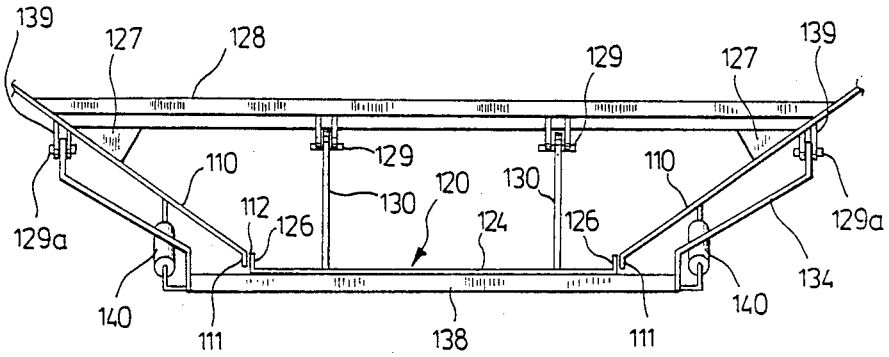
FIG. 4.

FIG. 6.
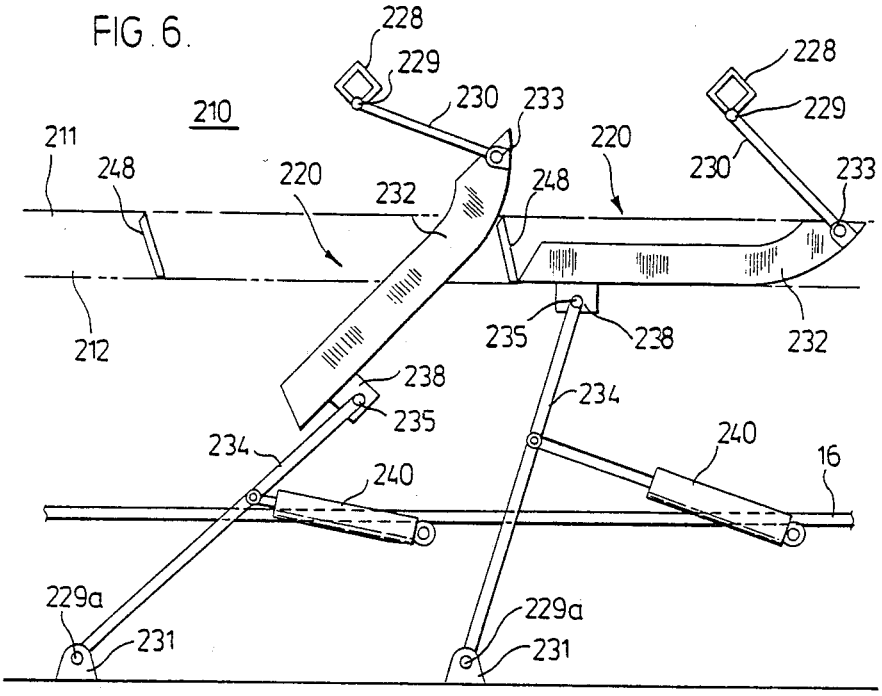
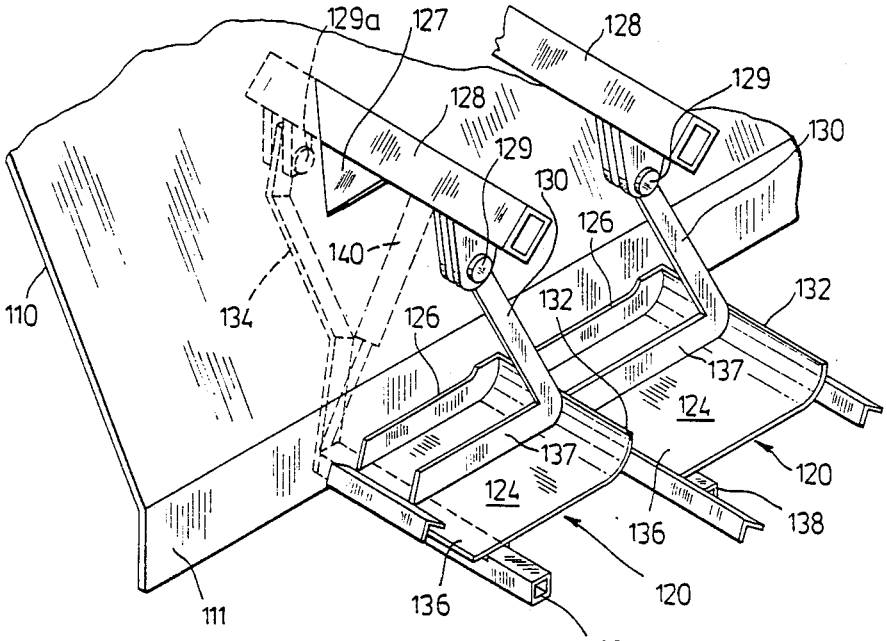
FIG. 5.

SWING GATES

FIELD OF INVENTION

This invention relates to apparatus for the handling of flowable solid materials, hereinafter referred to as particulate materials. It relates more specifically to improved gate structure for controlling the flow from such apparatus.

BACKGROUND OF INVENTION

Apparatus for controlling the flow of particulate materials normally comprises inwardly converging wall structure defining a throat opening at the lower end thereof, and into which the particulate material is funnelled by the wall structure. Within the throat there is normally located a movable gate for controlling the flow of particulate material through the gate. The apparatus may further comprise superior wall structure to define a containing hopper, and the ensuing description is made with reference to hoppers. However, it should be appreciated that such term is intended to cover apparatus wherein particulate materials are merely piled above a throat without being contained by a superior wall structure. Various types of gates are known, particularly for use with very large hoppers which may, for example, form a ship's hold, and amongst which may be exemplified roller gates and basket gates. It is well known that certain types of particulate material will not flow freely; thus it is found that certain materials, especially where they comprise large lumps, are prone to arch formation in the throat area. Other types of materials, especially fine, cohesive powdery materials, tend to block together, resulting in the formation of rat holes, arches or bridges.

Various expedients have hitherto been adopted or proposed for promoting the flow of particulate materials. Mechanical expedients comprise vibrators and movable members. Whilst certain of these have been found to be more or less suitable for use with specific particulate materials, others have not been found acceptable, primarily due to economic factors. The mechanical expedients may be combined with, or even supplanted by non-mechanical expedients, for example by coating the funnel wall structure to reduce frictional drag, and increasing the flow velocity through the throat opening in the so called bulk flow gate, whereby the energy of the moving material serves to break incipient arch and rat hole formation. However, the bulk flow gate engenders certain difficulty in containing and controlling the material flowing from the hopper.

It is then an object of this invention to provide hoppers with improved flow control means.

It is a further object of this invention to provide hoppers with relatively inexpensive structure for promoting flow through the funnel wall structure of the hopper.

It is a further object of this invention to provide a means for economically converting existing hoppers so as to provide therein improved flow control.

It is a still further object of this invention to provide a hopper wherein the flow rate therefrom may be variable from very high, bulk flow rate to low flow rates.

SUMMARY OF INVENTION

In accordance with one aspect of my invention a hopper for the handling of particulate materials comprises at least one gate for closing at least a portion of the throat opening of the hopper, and means for mounting the one gate whereby as that gate moves towards its open position a forward end thereof describes an arcuate path above the general level of the throat opening, which is to say within the confines of the funnel wall or thereabove, thereby digging, striking, disturbing or otherwise breaking up particulate material forming the wall of a rat hole, arch or bridge and promoting the recommencement of flow of material, means being provided for actuating the one gate. Normally, and particularly in large hoppers, a contiguous portion of the throat opening will be closed by at least one other neighbouring gate, and the arcuate path will desirably locate at least in part above the contiguous portion; means is further provided for operating the neighbouring gate preferably independently of the one gate. Assuming then the neighbouring gate to be opened and an arch or the like to have formed thereabove, the one gate may be opened, (or further opened if already part opened) so as to move above the neighbouring gate opening and break the wall of the arch thereby promoting flow through the neighbouring gate.

The arcuate path travelled by the one gate may vary appreciably in accordance with the means of mounting the gate. Expediently the gate may be mounted from one or more pivots defining a pivot axis. In accordance with another aspect of the invention the pivot axis locates generally above the throat opening of the hopper, and the one gate, which may be termed a swing gate, connects thereto by a link. Conveniently the link is in the form of first and second members which connect respectively to the swing gate adjacent the forward and rearward ends thereof. Expediently each member comprises a pair of laterally spaced apart arms. The arms of the second member, that is to say the rearward member, may connect to the pivot axis either internally or externally of the hopper. In accordance with this aspect the swing gate moves through a circular path about the pivot axis, and the degree of overlap of the contiguous portion of the throat opening will vary according to the location of the pivot axis relative to the swing gate in its closed position. It will also be appreciated that the location of the pivot axis will largely determine whether the swing gate will move towards an open or closed position under the influence of the hopper load. Generally speaking it is preferred that a single pivot axis be offset slightly from the axial centre of the swing gate towards the one end, whereby the swing gate has a tendency to move towards a slightly opened position but wherein the gate, when in its fully open position will have adequate penetration within the hopper whilst not unduly constricting the throat opening. Preferably the pivot axis will locate vertically above a transverse line which locates within the range of about 40 to 50 percent of the axial length of the swing gate, taken from the forward end thereof. It is contemplated that the effective penetration of the swing gate within the hopper may be increased by appendages which mount from the swing gate or the forwardly located link members.

In accordance with a still further aspect of the invention, the swing gate may be mounted from one or more other pivots defining a second pivot axis, and connected thereto by a second link. Normally the second pivot axis locates below the throat opening, the second link connecting to the rearward end of the gate by a hinge connection. In such embodiment the first and second ends of the gate define different circular arcs.

BRIEF DESCRIPTION OF THE DRAWINGS

The invention will be further described in relation to certain specific embodiments thereof, taken in conjunction with the accompanying drawings. FIG. 4 locates on the first sheet thereof, preceding the sheets containing FIGS. 2 and 3. In the drawings:

FIG. 1 shows in part transverse section a hopper incorporating an improved gate according to the invention, together with an underlaying conveyor such as may be used with large hoppers;

FIG. 4 is similar to FIG. 1, but show a different gate arrangement;

FIG. 5 is a view of the embodiment of FIG. 4 similarly taken to FIG. 3, and

FIG. 6 is a similar view to FIG. 2, but shows a still further embodiment.

DESCRIPTION OF THE PREFERRED EXEMPLARY EMBODIMENTS

Figure 2:
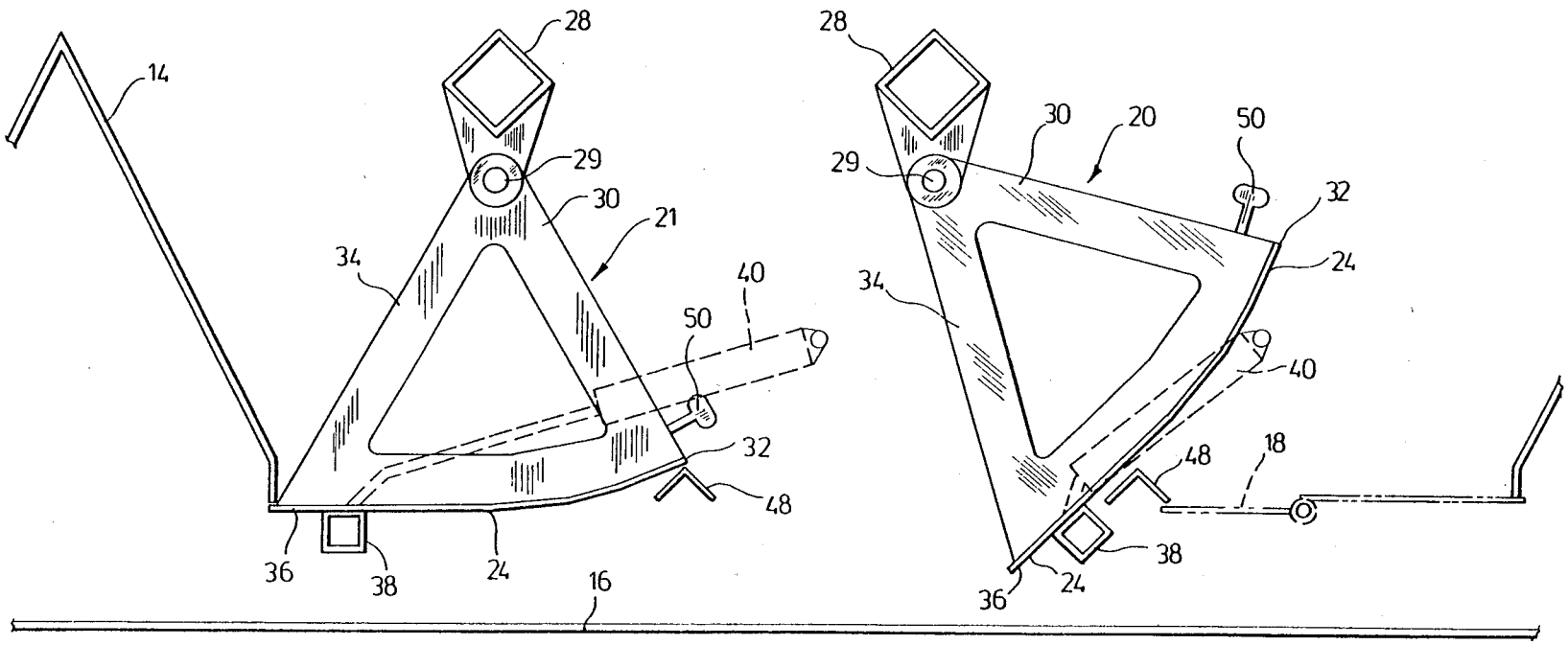
FIG. 2 shows the view of FIG. 1 taken along 2—2.
Figure 3:
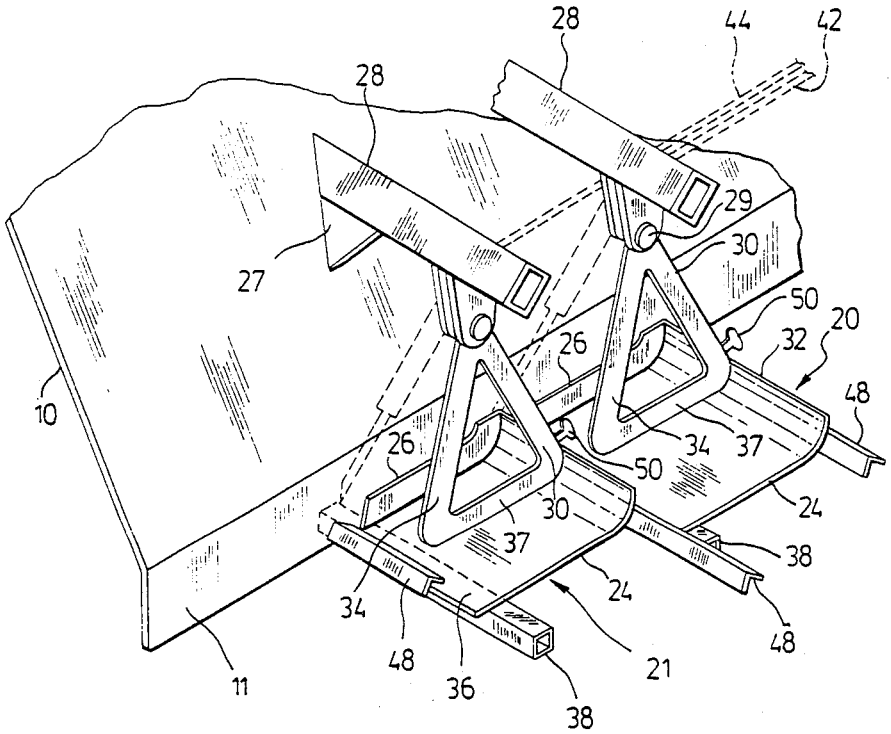
FIG. 3 is similar to FIG. 2 but taken in perspective and part broken away to reveal detail.

Referring now to FIGS. 1, 2 and 3 in detail, the lower, convergent and laterally spaced apart walls of a hopper are indicated by the numeral 10, distal portions thereof being downturned at 11 to form a throat opening 12 at the bottom of the hopper. The hopper is axially elongated, such as may comprise the hopper of a self unloading ship; whilst the throat opening 12 may be more or less continuous substantially along the length of the hopper, it is here considered to be interrupted at intervals by transverse spaced-apart members or hog backs 14 as are commonly employed in conjunction with roller track gates or basket gates for controlling flow from the hopper. A conveyor in the form of an endless belt 16 locates beneath throat opening 12 in axial alignment therewith, such conveyor not forming part of the invention however. Conveyor belt 16 is considered to travel from right to left in FIG. 2.

The gate installation typified by FIG. 2 is one such as may be provided in converting a roller track gate hopper system of an existing ship's hopper to a gate system in accordance with the instant invention. In such conversion the existing upstream gate, with reference to the movement of conveyor belt 16, and shown here as a roller track gate 18, is here left substantially undisturbed. The remaining portion of throat opening 12 is gated in accordance with the improved swing gates 20,21 of the invention. Since swing gates 20,21 are identical, only the one will be particularly described and referred to, except where the context requires otherwise.

Swing gate 20 comprises a floor 24 and lateral walls 26 upstanding therefrom so as to nest within hopper wall portions 11 so as to form a closure therebetween. An elevated fixture in the form of a gate support bar 28 is anchored to lateral hopper walls 10 to span therebetween above each swing gate 20, support bar 28 being strengthened by gussets 27. Gate 20 is linked to pivot support bar 28 at coaxial pivots 29 by a superstructure in the form of laterally spaced arms 30 which connect rigidly to gate floor 24 adjacent the upstream, or forward end 32 of the gate floor, which is here that end adjacent roller track gate 18, and a second pair of laterally spaced arms 34 which connect rigidly to the gate floor 24 adjacent the other axial end 36 thereof. The axially opposed ends of arms 30,34 are interconnected with small upstanding walls 37 which tend to stiffen floor 24 in the axial direction. A transverse, tubular member 38 which forms an engaging means for the gate actuator is rigidly secured to gate floor 24 adjacent gate end 36 on the underside thereof so as to extend laterally beyond the distal edges of hopper wall portion 11 beneath throat 12. Hydraulic actuators 40 connect between each end of tubular member 38 and hopper wall 10 or any point fixed relative thereto. Actuators 40 are seen in dotted outline in FIG. 2, that associated with swing gate 21 being shown in its extended position wherein the swing gate is closed, that associated with swing gate 20 being shown only in its contracted, open gate position for clarity. Separate hydraulic control lines 42,44 are provided for independently actuating the hydraulic actuators 40 associated with swing gates 20,21 respectively. A similar control line (not shown) is provided for independently actuating roller track gate 18, no particular actuating means being here illustrated, however. Whilst it is preferable that the operation of one gate be independent of that of its neighbours, it will be appreciated that the operation of non-neighbouring gates may be inter linked without serious detriment, and the ganged operation of adjacent gates is not precluded.

Axial sealing between throat opening 12 and gate 20 is provided in the manner previously spoken of, that is to say the upstanding walls 26 of swing gate 20 nesting closely within hopper wall portion 11 of throat opening 12. Transverse sealing is provided by stops 48 which secure to wall portions 11 so as to abut closely the first axial end 32 of a one gate and the other end 36 of the adjacent gate. The forward end portion 32 of swing gate 20 is upwardly deformed, preferably being radiused on pivot 29, although this is conveniently approximated by one or more chords in the manner generally illustrated. Stop 48 then conveniently underlays a one end of floor 24 and overlays the other end of the adjacent gate. The upwardly deformed end 32 of gate 20 generally stiffens that end of the gate, end 34 being stiffened by tubular member 38. More importantly, it is found that the generally upturned end 32 of floor 24 facilitates the movement of swing gate 20 through the material contained in the hopper.

Actuation of hydraulic actuators 40 of swing gate 20 or 21 causes the gate to move about pivot 29 on a circular arc, the forward end 32 of the gate being drawn upwardly into the stored material. The locus of end 32 will depend upon the position of pivot 29 in relation to the gate opening. Generally pivot 29 will locate intermediate the ends 32,36 of swing gate 20, the radius of the locus being such that as the swing gate moves to its fully opened position, i.e. the position assumed by gate 20 in FIG. 2, gate 21 being shown in its closed position, forward end 32 moves in vertical planes above the opening of the adjacent gate, here roller track gate 18. The precise position of pivot 29 is not critical, but it will be appreciated that the actual position somewhat influences the characteristics of swing gate 20. Thus where pivot 29 locates off the axial center, towards rearward end 36 of the swing gate, the gate will tend to be normally shut, vertical penetration within the hopper increased and axial overlap of the adjacent gate decreased. Conversely, as the pivot 29 locates towards the forward end 32 of the swing gate, the gate tends to be normally open, the vertical penetration decreases and the axial overlap increases. Generally speaking, it is preferred that the axis of pivot 29 locate with the range of about 40 to 50 percent of the axial length of swing gate 20 from the forward end thereof, whereby a suitable balance between the above factors is obtained, and also whereby the swing gate when in its fully opened position least obstructs the throat opening. The effective penetration of a swing gate within the hopper may be increased by the simple expedient of providing one or more appendages which may be in the form of protuberances as seen at 50 on forward portions of gate 20.

Having described the general mechanical principles of the embodiment of FIGS. 1, 2 and 3, the operation thereof will be described. In the ensuing discussion, reference to gate 20 is intended to differentiate from gate 21. Generally speaking, in unloading the hopper, the upstream gate will first be opened, such gate here comprising roller track gate 18. Assuming flow therethrough to become stopped or reduced through rat hole or arch formation, the actuation of the adjacent gate, here gate 20, will break out the wall of the rat hole or the arch, and the flow through gate 18 will recommence. Where it is desired to increase the flow from the hopper, gates 18 and 20 may be opened simultaneously. To some extent arches may form to bridge across gate 18 onto forward end 32 of gate 20; such arch formation may be broken by closing gate 20, so as to restart flow through gate 18. Rat hole formation will not be likely with both gates 18 and 20 open, but should it occur it can be broken by actuation of swing gate 21 in the same manner as swing gate 20 as earlier described. Where it is desired to increase flow from the hopper still further, gates 18,20 and 21 may each be opened. Rat hole formation and arch formation become less probable in that instance because of the increased dimension of the hopper opening in the axial direction and because the flow rate in the funnel section and throat of the hopper tends to increase disproportionately with the opening size.

It will be remarked that swing gates 20 function as chutes to direct material flow from the hopper in an orderly manner onto conveyor belt 16 and provide such material with a velocity component in the direction of the motion of the belt. This action is quite unlike that found with basket gates and bulk flow gates, and leads to considerably less wear and tear upon both the belt and its supporting structure. It is further found that less spillage from the conveyor belt 16 results from the use of swing gates; in part this is due to the axially aligned walls comprising lateral walls 26 and walls 37 which connect between the opposed arm members 30,34 which function to reduce the lateral velocity component of material induced by conveyor walls 10. Other axially aligned walls may be found advantageous in reducing spillage still further.

It will be appreciated that the first embodiment is described particularly in relation to the possible conversion of an existing hopper and gate structure. Whilst in such embodiment three gates in end to end relationship were illustrated, the invention is not restricted to any particular number of gates.

Considering now the embodiment of FIGS. 4 and 5, parts which are identical or functionally similar to those of the first embodiment will be referenced similarly in the hundred series. A hopper having convergent side walls 110 downwardly turned at 111 to form a throat 112 is provided with a plurality of swing gates 120 in end to end relationship to close throat 112. Each said swing gate comprises a floor 124 and upstanding lateral walls 126 extending along the side thereof. A gate support bar 128 spans between hopper walls 110, and is linked to gate 120 by a forward pair of laterally spaced arms 130 at coaxial pivots 129, defining a pivot axis, arms 130 being rigidly attached to floor 124 as by welding adjacent the forward end 132 thereof. Support bar 128 is strengthened by gusset supports 127, and floor 124 is strengthened by axially aligned wall 137, which wall also serves to reduce transverse movement of material unloaded from the hopper much in the same manner as walls 37 function in the prior discussed embodiment. A tubular member 138 secures to the floor 124 of gate 120 on the underside of rearward end 136 to extend laterally beyond the walls 111 of throat 112. The rearward end 136 of swing gate 120 is linked externally to the hopper to pivot **129*a* by laterally spaced arms 134 which connect rigidly to tubular member 138. Pivot 129*a* is collinear with pivot 129 and is mounted externally to the hopper by mounting blocks 139 which secure to walls 110; equally gate support bar 128 may be made to project externally to the hopper so as to provide a support for pivots 129*a* if desired. Hydraulic actuators 140 connect between hopper wall 110 and rearward arms 134**, separate control lines (not shown) being provided for the independent actuation of neighbouring swing gate.

Since pivots 129, **192*a* locate on a common pivot axis, it will be appreciated that the movement of swing gate 120** is along the arc of a circle, centred on the pivot axis, and that the position thereof will control the movement thereof in precisely the same manner as in the first discussed embodiment.

Turning now to the embodiment of FIG. 6, a hopper having wall structure essentially as earlier described and comprising convergent walls 210 with downwardly dependent wall portions 211 defining a throat opening 212 is closed by swing gates 220 constructed in accordance with earlier defined principles. Swing gates 220 are mounted to pivot about a first pivot axis defined by pivot 229 and a second pivot axis defined by pivot **229*a* parallel thereto but spaced therefrom. Gate support bar 228 locates above throat 212, and is conveniently supported from hopper walls 210, the forward end 232 of swing gate 220 being linked to support bar 228 at pivots 229. Pivot 229*a* locates externally to the hopper, and is supported in a lower fixture in the form of blocks 231 which secure to an element fixed in relation to the hopper. The link between swing gate 220 and support bar 228 comprises a pair of forward, laterally spaced arms 230 which hingedly connect adjacent the forward end 232 of the swing gate at hinge point 233. Similarly the link between swing gate 220 and blocks 231 comprises a pair of rearward, laterally spaced arms 234 mounted on coaxial pivots 229*a* and which hingedly connect at hinge points 235 to transverse tubular member 238 secured to swing gate 220** adjacent the rearward end thereof.

Hydraulic actuators 240 connect at one end thereof to rearward arms 234 and at the other end to an element fixed in relation to the hopper. A modified means is shown here for effecting a seal between adjacent swing gates, comprising a flat bar stop 248, the lower edge of which contacts the rearward end of one gate and the forward end of an adjacent gate.

The foregoing embodiments are exemplary only of the invention, particularly in its broad aspects, and they are not intended to be limitative thereof. Indeed many variations therefrom will occur to persons skilled in the art so as to achieve one or more ends, objectives and advantages as are put forward herein. Whilst the illustrative embodiments relate particularly to very large installations utilizable with conveyors for off-loading and the terms "forward end" and "rearward end" of the gate have particular meaning in relation to the direction of travel of the belt, in their broader sense the forward end of any swing gate will be the leading end of the gate as the gate is opened.

I claim:

1. An apparatus for containing and discharging masses of particulate material prone to blocking in a hopper to form rat holes, arches or bridges, including an elongated hopper for positioning above an elongated conveyor belt extending in a substantially horizontal direction from an upstream end to a downstream end, said hopper having a discharge structure including opposed downwardly and inwardly sloping sides extending towards each other to terminate in elongated parallel margins defining between them an elongated discharge channel to overlie the conveyor, transverse spaced-apart members extending between the respective margins to divide the discharge channel into a series of outlets in the direction of travel of the belt, and gate means for each outlet for forming part of a floor to the hopper when closed and when opened to allow controlled discharge of the material from the outlet as it gravitates from the sloping sides, the gate means in each outlet comprising a plurality of gates arranged in series in the longitudinal direction of the discharge channel, each gate having a floor constructed to cover a discreet portion of an outlet and to cooperate with the floor of at least one other gate to close the entire outlet between adjacent spaced apart members, at least one gate of each plurality being a swing gate means for mounting the floor of the swing gate for arcuate movement in an upward and upstream direction about a horizontal axis elevated with respect to the level of the outlet and transverse to the longitudinal direction of the discharge channel, the means for mounting permitting the swing gate floor to move from a closed position to an open position within the hopper in which at least part of the swing gate floor extends over an immediately adjacent discreet portion of the outlet, and power means, acting separately on each gate, whereby the gates may be forcibly moved individually back and forth between closed and open positions.

2. An apparatus, as defined in claim 1, in which a superstructure extends upward from the floor of each swing gate and is pivotally mounted to a fixed support extending transversely to the hopper.

3. An apparatus, as defined in claim 2, in which the superstructure includes a pair of spaced-apart arms extending from the upstream end of the floor to the pivotal mounting.

4. An apparatus, as defined in claim 3, in which a companion pair of arms extend upward from the downstream end of the floor of the swing gate to connect with the arms extending from the upstream end.

5. An apparatus, as defined in claim 1, in which the floor of the swing gate is provided with a shallow divider wall extending upwardly therefrom intermediate its sides to restrain the transverse movement of the material thereon.

6. An apparatus, as defined in claim 1, in which the floor is provided with engaging means extending laterally beyond the discharge channel and said power means acts outside the hopper on the engaging means to move the swing gate.

7. An apparatus, as defined in claim 6, in which the engaging means is a beam mounted underneath the floor and extending laterally therefrom beyond said elongated parallel margins defining the discharge channel.

8. An apparatus, as defined in claim 1, in which the floor of each swing gate has an upstanding shallow wall extending upward at each side to stiffen the floor and seal against the outlet channel margins.

9. An apparatus, as defined in claim 1, in which the floor of each swing gate is provided at its upstream end with an upwardly curved part for dislodging material as it moves up into the hopper.

10. An apparatus, as defined in claim 1, in which the swing gate is provided with means projecting therefrom in an upstream direction to dislodge material in the hopper.

11. An apparatus, as defined in claim 1, in which the floor of each swing gate is pivotally connected at its upstream end to an arm pivotally connected to an elevated fixture above the outlet and at its downstream end to an arm pivoted to a fixture below the outlet and the power means acts on the lower arm to move the floor between closed and open positions.

12. An apparatus, as defined in claim 1, in which the gate means in each outlet includes at least two adjacent swing gates which are independently operated.

13. An appartus, as defined in claim 1, in which the floor of each swing gate is pivotally mounted to an elevated fixture on an axis perpendicularly above a position offset from the center of its discreet portion of the outlet in the longitudinal direction of the discharge channel.

14. An apparatus, as defined in claim 1, in which the floor of the swing gate is provided with an upwardly curved part at its upstream end, and an upstanding shallow wall extending upward at each side to stiffen the floor and seal it against the outlet channel margins.

15. An apparatus, as defined in claim 14, in which the floor is provided with a shallow divider wall extending upwardly therefrom intermediate its sides to restrain the transverse movement of the material thereon.

* * * * *